US009349514B2

(12) United States Patent
Taylor et al.

(10) Patent No.: US 9,349,514 B2
(45) Date of Patent: May 24, 2016

(54) MAGNETIC WATERPROOF COVER FOR VEHICLE DOOR HANDLES AND METHOD OF ASSEMBLY

(71) Applicants: Kevin Darrell Taylor, Farr West, UT (US); Michael Phillip Taylor, Farr West, UT (US)

(72) Inventors: Kevin Darrell Taylor, Farr West, UT (US); Michael Phillip Taylor, Farr West, UT (US)

( * ) Notice: Subject to any disclaimer, the term of this patent is extended or adjusted under 35 U.S.C. 154(b) by 54 days.

(21) Appl. No.: 14/297,702

(22) Filed: Jun. 6, 2014

(65) Prior Publication Data

US 2015/0357105 A1 Dec. 10, 2015

(51) Int. Cl.

| | |
|---|---|
| ***H01F 7/02*** | (2006.01) |
| ***E05B 77/34*** | (2014.01) |
| *E05B 47/00* | (2006.01) |

(52) U.S. Cl.

CPC ..... *H01F 7/0252* (2013.01); *E05B 77/34* (2013.01); *E05B 47/0038* (2013.01); *Y10T 29/49828* (2015.01); *Y10T 29/49865* (2015.01)

(58) Field of Classification Search

CPC ..... B60J 11/06; H01F 7/0252; E05B 17/14; Y10T 29/49828; Y10T 29/49865

USPC ..... 335/302–306, 216; 29/446, 428; 55/500, 502, 503

See application file for complete search history.

(56) References Cited

U.S. PATENT DOCUMENTS

| | | | | |
|---|---|---|---|---|
| 3,434,318 | A | 3/1969 | Thiry | |
| 3,782,149 | A | 1/1974 | Carter | |
| 3,861,182 | A | 1/1975 | Skinner | |
| 4,090,379 | A | 5/1978 | Lehner | |
| 4,781,231 | A * | 11/1988 | Garcia | B60J 11/06 224/42.11 |
| 4,825,673 | A | 5/1989 | Drake | |
| 5,919,541 | A | 7/1999 | Emory | |
| 7,213,853 | B2 * | 5/2007 | Elwell | B60R 13/00 296/1.08 |
| 8,540,792 | B2 | 9/2013 | Crook | |
| 2006/0006969 | A1 * | 1/2006 | Cassar | B23Q 3/1546 335/306 |
| 2011/0226394 | A1 * | 9/2011 | Rodriguez | B60J 11/06 150/166 |
| 2014/0115829 | A1 * | 5/2014 | Schrader | E05B 1/0015 16/412 |

FOREIGN PATENT DOCUMENTS

| | | | |
|---|---|---|---|
| DE | 202011100394 | U1 | 8/2011 |
| KR | 20140027737 | A * | 3/2014 |
| WO | 8807118 | A1 | 9/1988 |

* cited by examiner

*Primary Examiner* — Bernard Rojas

(74) *Attorney, Agent, or Firm* — Dowell & Dowell, PC

(57) ABSTRACT

A vehicle door handle cover includes a flexible waterproof sheet and a flexible waterproof handle attached to the sheet. The handle may be removable, and preferably has a length that is longer than the length of the sheet, such that the handle is retained in an outwardly bowed position in use. Magnets connected to the sheet adhere to a metal vehicle body to attach the cover to the vehicle in a removable manner. The magnets may be retained within first and second magnet holders that are inserted into pockets formed in the sheet. Barbs formed on the holders help retain the holders within the pockets. Each magnet is positioned with the polarity of the magnet in the same direction, and the magnets on the holders align such that the holders attract one another, allowing the vehicle door handle cover to be folded into a storage position.

19 Claims, 7 Drawing Sheets

MAGNETIC WATERPROOF COVER FOR VEHICLE DOOR HANDLES AND METHOD OF ASSEMBLY

BACKGROUND OF THE INVENTION

1. Field of the Invention

The present invention pertains to the art of motor vehicle accessories, and more particularly, to weather-related protection devices for motor vehicles.

2. Discussion of the Prior Art

When a parked motor vehicle is in an outdoor area experiencing snowfall, sleet, or icy conditions, door handles and door locks on these vehicles can get accumulations of snow or ice that make locating and operating the handles difficult or impossible until cleared. Handles on vehicles can easily become stuck and unusable in such conditions, and keys cannot be inserted into locks that are iced over.

Protective devices for vehicle door latches and locks are generally known. In one example set forth in U.S. Pat. No. 4,090,379, a protector utilizes a magnetic frame adapted to be placed over the periphery of a frangible sheet material. In use, the sheet material is placed over a door handle and the magnetic frame is placed over the sheet to hold the sheet in place. When the motorist is ready to open the door, they rupture the frangible sheet to access the handle. Although useful, the sheet of the '379 patent cannot be reused once ruptured, and the two handed approach to placing the protector on a car may be awkward and difficult for certain users. Further, the type of flexible rubber strip magnets utilized by the '379 patent lose strength in colder weather, and are not practical for use in winter.

A similar design in German patent document DE202011100394 teaches a magnetic detachable cover, wherein the corners of the cover are stitched in a round shape to accept magnets therein. However, this type of cover must also be either ruptured or pulled off by gripping a thermo foil center piece, which may be difficult in cold weather, especially when a user is wearing gloves. Further, it is noted that that inserting individual pieces of magnet into corner pockets of the cover adds to the complexity of manufacturing.

U.S. Pat. No. 8,540,792 is directed to another similar flexible magnetic cover. Magnets are attached to a flexible sheet via adhesive, heat sealing the magnets within the sheet, or sewing the magnets into the sheet. However, it should be noted that cold weather can negatively affect many types of adhesives. It may also be difficult to heat seal magnets into the sheet, when the magnets have a tendency to be attracted to surrounding metal parts, such as the heat sealer itself. Likewise, it may be difficult to sew strong magnets into the sheet, since the magnets will have a tendency to stick to metal of the sewing machine during manufacturing.

Therefore, there is seen to be a need in the art for a reusable and simply manufactured cover that is easily removed from a vehicle by a user, while being securely attached to the vehicle when in use.

SUMMARY OF THE INVENTION

The present invention is directed to a vehicle door handle cover comprising a flexible waterproof sheet sized to fit over a vehicle door handle, the sheet having a length including opposing outer surfaces. A flexible waterproof handle is attached to the sheet. In one embodiment, the handle is a removable handle having first and second ends that are inserted into respective opposing handle retaining pockets formed in the cover. In a preferred embodiment, the handle has a length that is longer than the length of the sheet, such that the handle is retained in an outwardly bowed position with respect to the sheet. A plurality of magnets connected to an outer periphery of the flexible waterproof sheet adhere to a metal vehicle body in order to attach the vehicle door handle cover to the vehicle body in a removable manner.

The magnets may be retained within first and second magnet holders that are inserted into respective opposing pockets formed in the sheet. Barbs formed on the first and second magnet holders may be utilized to help retain the holders within the pockets. Preferably, each magnet is positioned with the polarity of the magnet in the same direction and the plurality of magnets on the first magnet holder align with the plurality of magnets on the second magnet holder such that the first and second magnet holders attract one another, allowing the vehicle door handle cover to be folded into a storage position.

Additional objects, features and advantages of the present invention will become more readily apparent from the following detailed description of a preferred embodiments when taken in conjunction with the drawings wherein like reference numerals refer to corresponding parts in the several views.

DETAILED DESCRIPTION OF THE PREFERRED EMBODIMENTS

Figure 1:
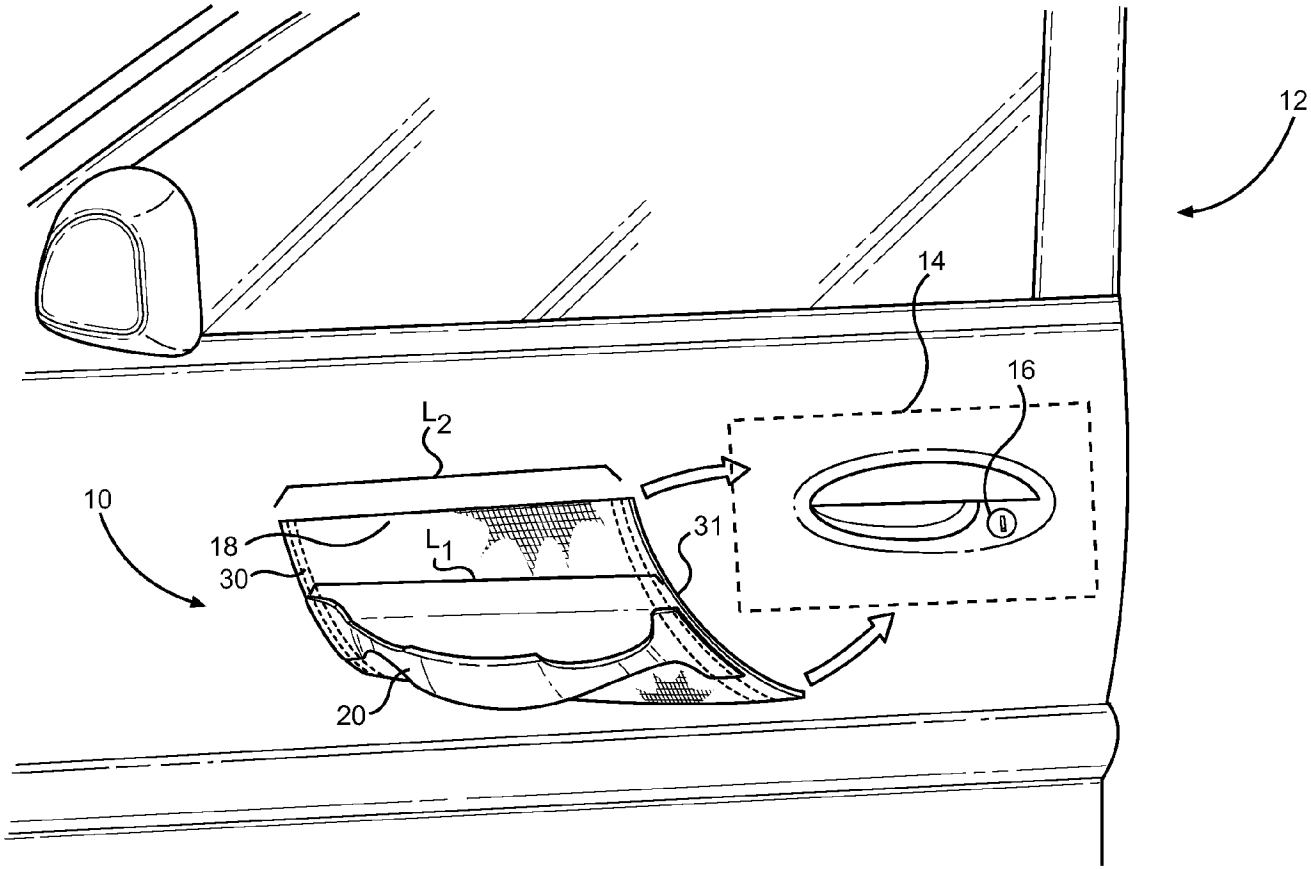
FIG. 1 is a perspective view of a cover of the present invention being applied to a vehicle door.

With initial reference to FIG. 1, a flexible vehicle door handle cover depicted at 10 is adapted to magnetically attach to a motor vehicle 12. More specifically, cover 10 is adapted to securely attach to an area 14 about a vehicle door handle and lock 16. Cover 10 includes a main body 18 comprising a flexible waterproof and weatherproof sheet material, and a handle 20. The sheet material may comprise vinyl, rubber, a woven material, plastic, a combination thereof, or any other flexible waterproof and weatherproof material. In a preferred embodiment, the sheet material is a durable non-frangible or tear-resistant material adapted to be reused through multiple applications. Main body 18 is sized to fit over a vehicle door handle and lock. In one embodiment, main body 18 is approximately 6 inches by 8.5 inches (approximately 15.24-21.59 cm).

Handle 20 is also constructed of a flexible waterproof and weather proof material. Handle 20 can be made in a solid, woven or webbed form using plastic or other waterproof and weatherproof material, or combinations of such material. Handle 20 may be sewn, fused, or otherwise permanently attached to main body 18. Alternatively, handle 20 may be removably attached, as will be discussed in more detail below.

In a preferred embodiment, handle 20 comprises a single piece of flexible plastic, and has a length $L_1$ along its longitudinal axis that is longer than a length $L_2$ of the main body 18 to which it is attached. With this configuration, handle 20 bows outwardly above main body 18, as depicted in FIG. 1. Upwardly extending handle 20 advantageously improves visibility of the handle, and enables a user to easily grab the handle, even when snow has accumulated on cover 10 or when the user's hands are encased in bulky gloves. Preferably, handle 20 has a flexibility which is less than the flexibility of main body 18. This stiff, long handle configuration provides tension to the flexible main body 18 by applying pressure at opposing ends 30 and 31. It should be appreciated that such a tensioning device enables a user to more easily apply the flexible main body 18 to a vehicle 12 with one hand, and eliminates the need for a user to utilize two hands to spread the flexible sheet over the door handle area 14.

Figure 2:
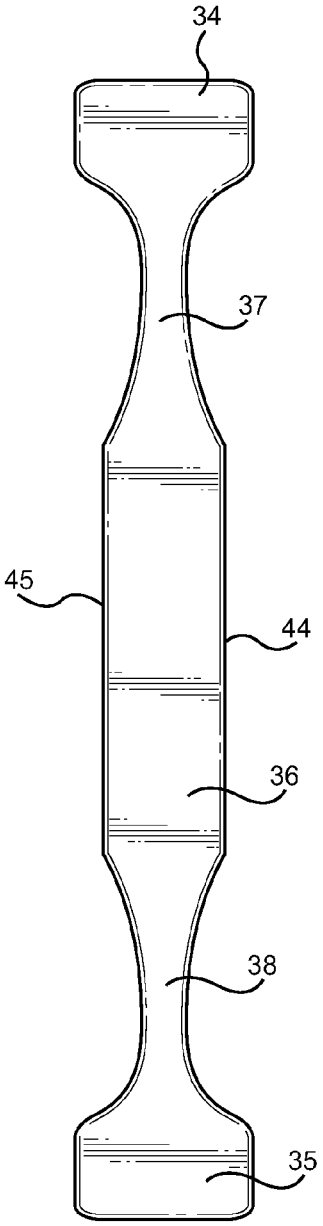
FIG. 2 is a top view of a handle for use with a cover of the present invention.
Figure 3:
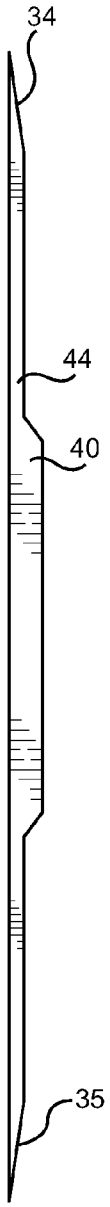
FIG. 3 is a side view of the handle of FIG. 2.
Figure 4:
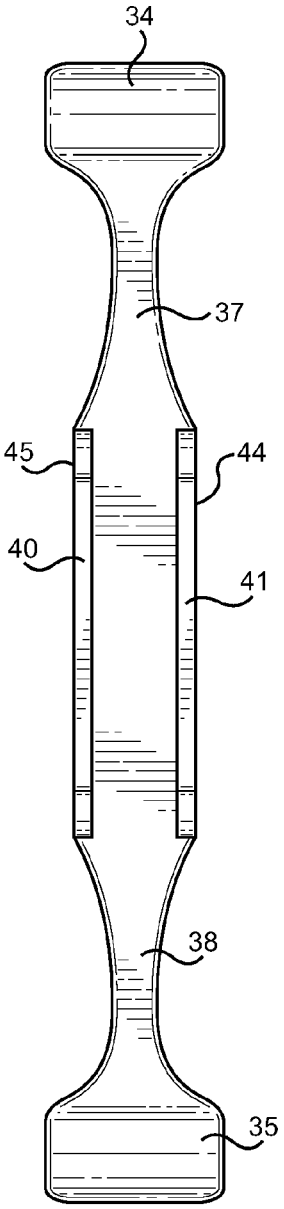
FIG. 4 is a bottom view of the handle of FIG. 2.

Handle 20 may take on any convenient configuration. In a preferred embodiment shown in FIGS. 2-4, handle 20 includes opposing ends 34 and 35, which are each separated from a mid or main handle portion 36 by respective tapered portions 37 and 38 having a width that is less than the width of the opposing ends 34 and 35 and the main handle portion 36. As shown in FIGS. 3 and 4, stiffening ribs 40 and 41 are formed on opposing side edges 44 and 45 of the main handle portion 36. Stiffening ribs 40 and 41 provide structural support and stiffness to handle 20, thereby aiding in the positioning of handle 20 in its outwardly bowed position.

Figure 5:
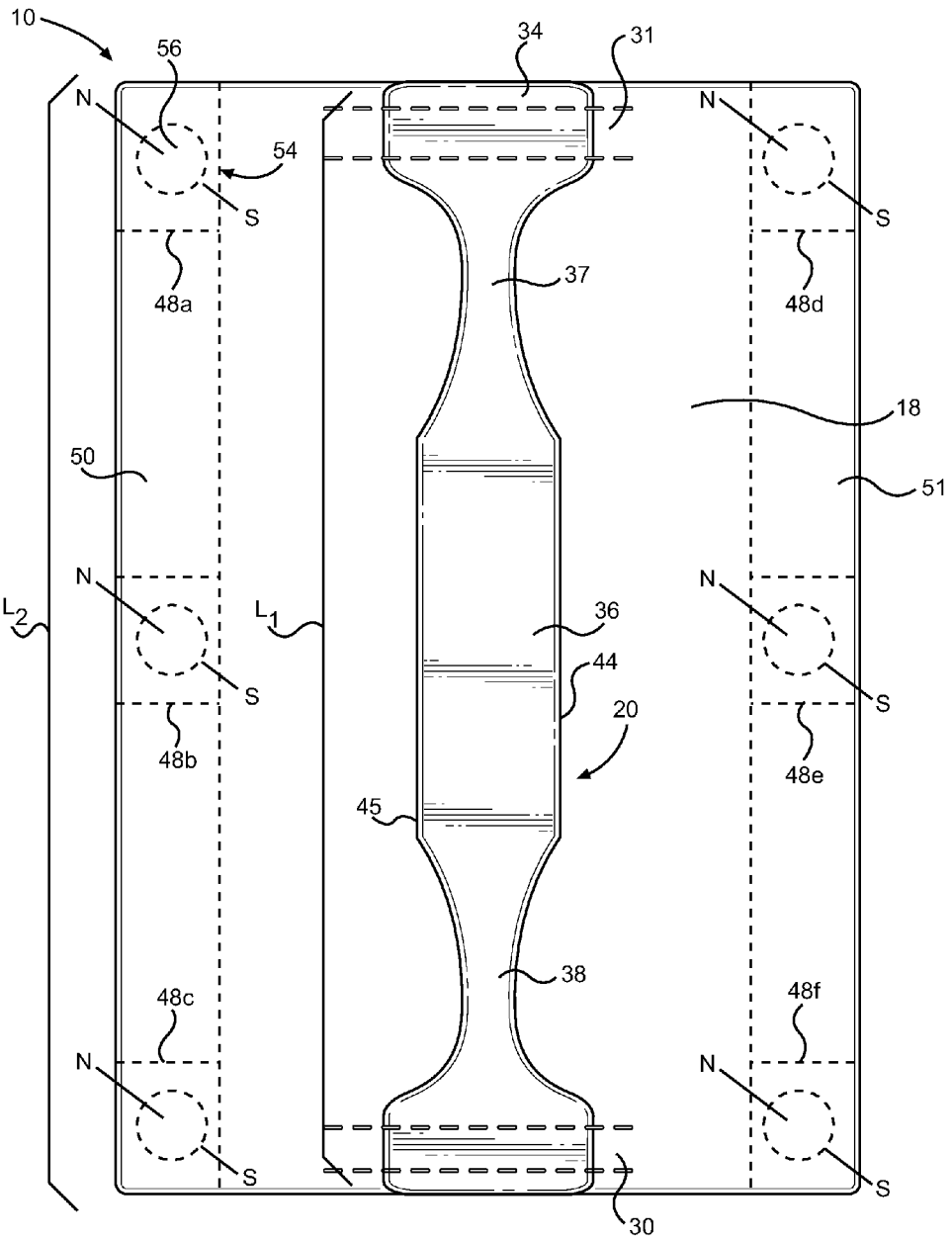
FIG. 5 is a top view of a cover of the present invention including individual magnet pockets.
Figure 6:
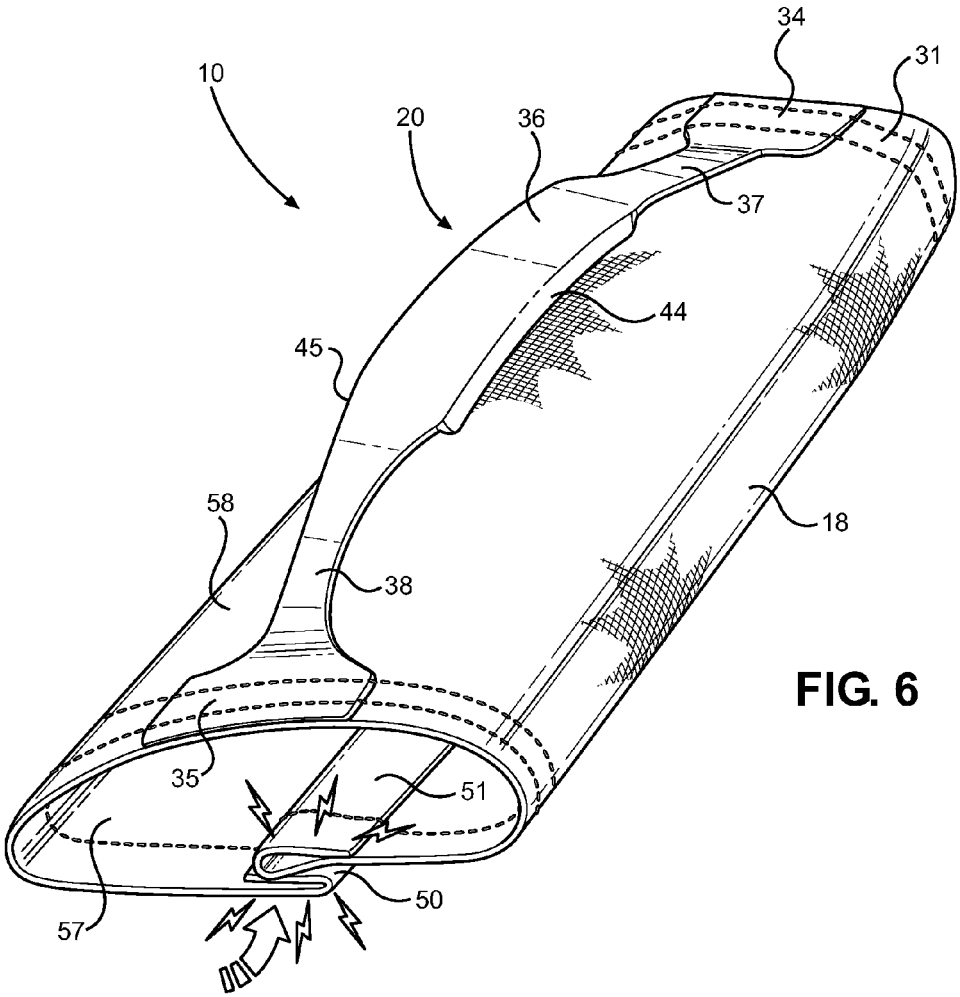
FIG. 6 is a perspective view of a cover of the present invention in a folded, storage position.

With reference to FIG. 5, one embodiment of cover 10 is shown wherein handle 20 is sewn to ends 30 and 31 of main body portion 18. Each side portion 50 and 51 is folded over itself and a plurality of pockets 48*a*-48*f* are sewn or otherwise formed into the elongated side portions 50 and 51 of main body 18. Pockets 48*a*-48*f* each include a small opening 54 into which a magnet 56 is inserted. The openings 54 may be subsequently sewn shut or otherwise closed, or may be left open. Magnets 56 are preferably made of a high-strength magnetic material, such as neodymium. However other materials can be used in the construction of the magnets 56, such as rubber, cobalt, samarium, ferrite, or ceramics. Although six magnets 56 are shown, it should be understood that any desirable number of magnets can be utilized. Preferably, magnets 56 are oriented such that all magnets 56 have their polarity N-S oriented in the same way. That is, each magnet 56 is positioned such that its polarity is aligned in the same manner with a longitudinal axis (not shown) of the cover 10. Further, magnets 56 on one side of cover 10 align with magnets 56 on an opposing side of cover 10. With this configuration, cover 10 can be folded into a storage position as depicted in FIG. 6, wherein side portions 50 and 51 are attracted to one another due to the attraction of opposing magnets 56. When in the storage position, a bottom side 57 of cover 10, which may be wet and/or dirty from contact with the outside of vehicle 12, is retained within the folded cover 10, while an outer side 58, having the handle 20 attached thereto, is available to a user. The strong magnetic connection between opposing side portions 50 and 51 retains cover 10 in the storage position until a user pulls them apart. This enables cover 10 to be neatly folded and stored away, while preventing individual magnets from inadvertently magnetically adhering to metal objects in their vicinity.

Figure 7:
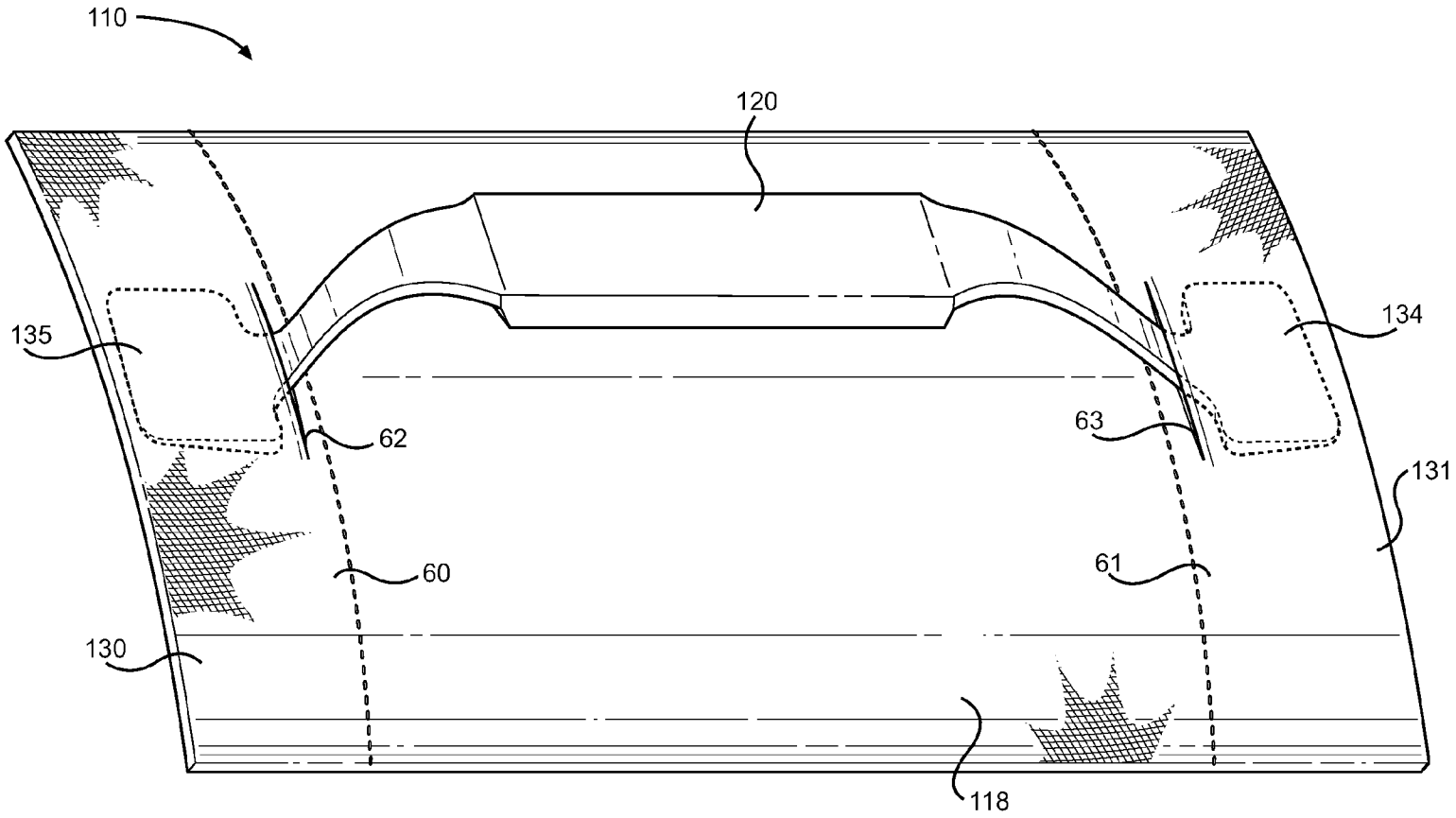
FIG. 7 is an alternative cover of the present invention including a removable handle.

In another embodiment shown in FIG. 7, a cover 110 of the present invention includes a detachable handle 120. Opposing ends 130 and 131 of cover 110 each include a pocket 60 and 61 accessible to a user via respective slots 62 and 63. As shown, end portions 134 and 135 of handle 120 have essentially a t-shape. In use, a user inserts end 135 of detachable handle 120 through slot 62 into pocket 130 and, bending 120 slightly, inserts end 34 of handle 120 through slot 63 into pocket 61. Slots 62 and 63 are at least slightly shorter in length then the length of the end portions 134 and 135. With this configuration, handle 120 is retained within pockets 60 and 61 by t-shaped end portions 134 and 135, and the stiffness of handle 120 creates a bowed effect whereby handle 120 extends upwardly away from main body 118 of cover 110.

Figure 8:
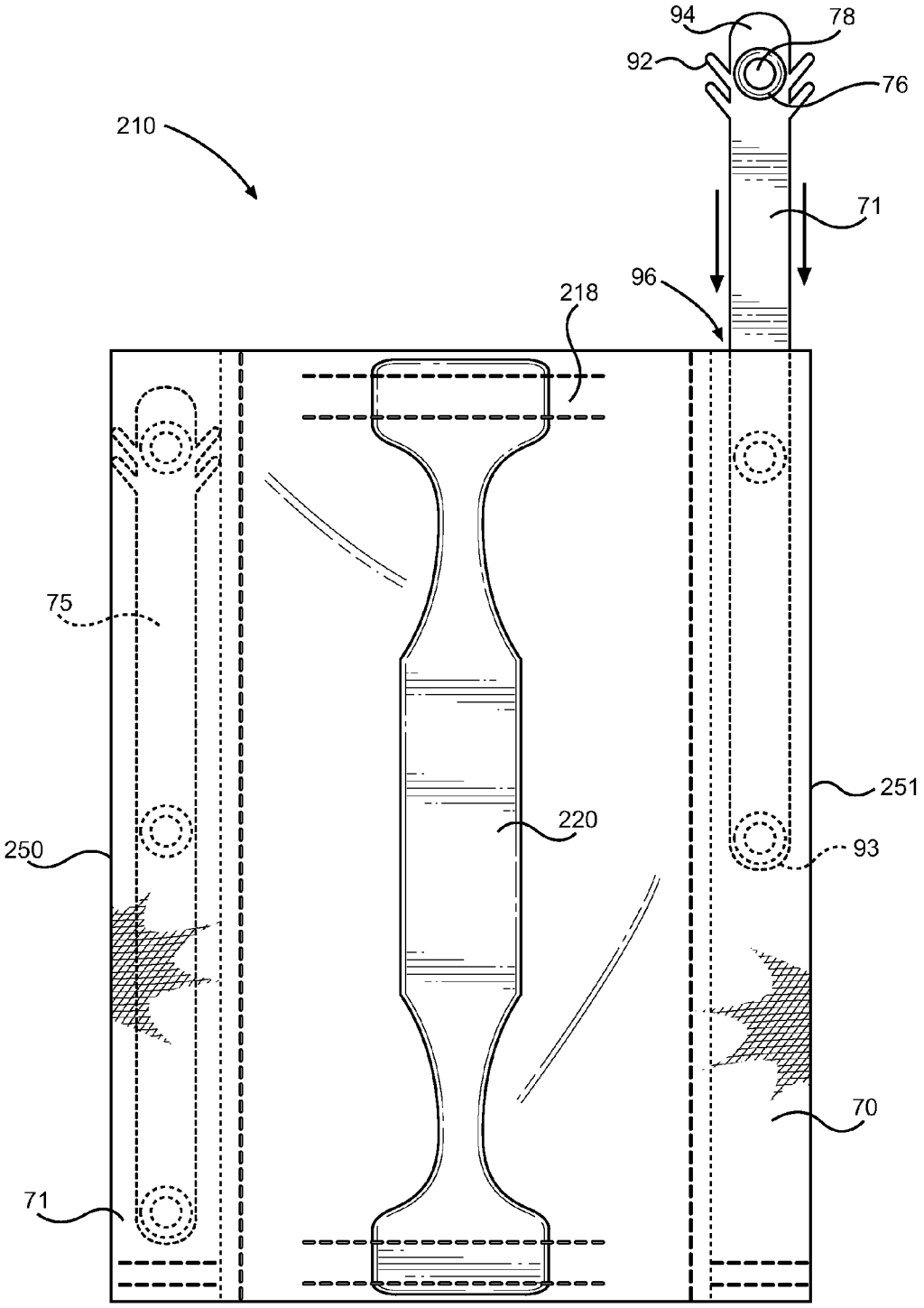
FIG. 8 is another cover of the present invention including magnet holders.
Figure 9:
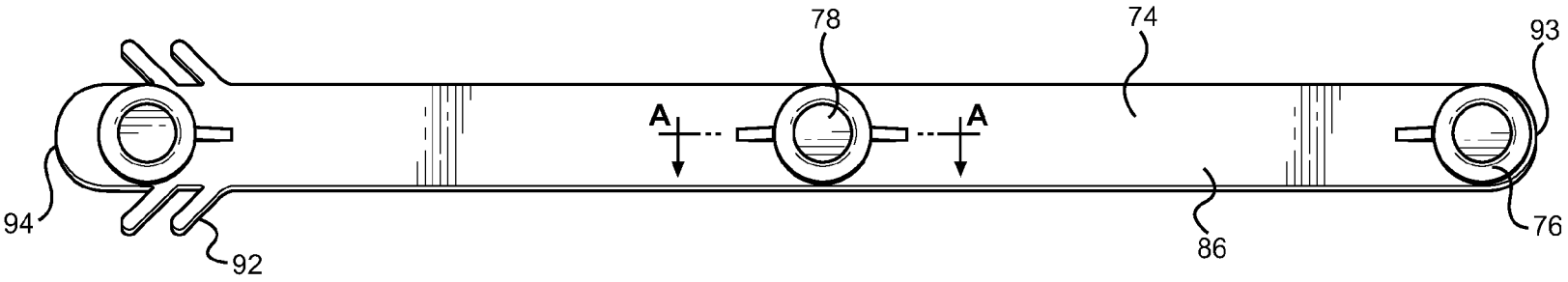
FIG. 9 is a top view of a magnet holder of FIG. 8.
Figure 10:
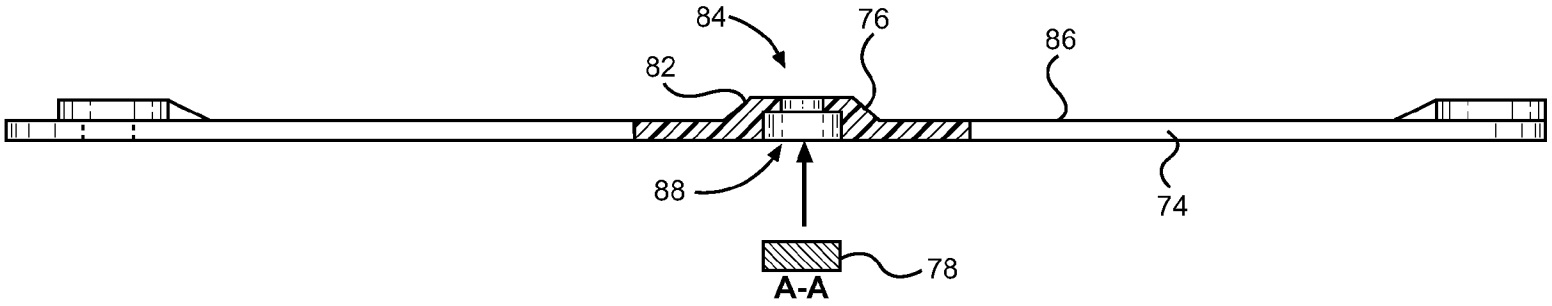
FIG. 10 is a side view of a magnet holder of FIG. 8.

In yet another embodiment depicted in FIG. 8, a cover 210 of the present invention includes opposing pockets 70 and 71 sewn or otherwise formed into elongated side portions 250, 251 of cover 210. A handle 220 is sewn or otherwise attached to main body portion 218. First and second magnet holders 74 and 75 are sized to fit within respective pockets 70 and 71. Details of magnet holders 74 and 75 will now be discussed with reference to FIGS. 9-10. First and second magnet holders 74 and 75 have a length constructed from plastic, metal or other material having a stiffness greater than the stiffness of the material of cover 201 and sufficient to hold a plurality of magnets 74 attached thereto in a spaced relationship within cover 210. First and second magnet holders 74 and 75 are preferably identical in structure, and therefore, only magnet holder 74 will be discussed in detail herein. Magnet holder 74 includes a plurality of magnet retaining members 76, each adapted to hold a respective magnet 78. In the embodiment shown, magnet retaining members 76 are in the form of pockets 80 formed into the body of magnet holder 74. Although three pockets 80 are shown, it should be understood that any desired number of pockets 80 and corresponding magnets 78 may be utilized. For each magnet retaining member 76, a rim 82 defines an opening 84 through which a portion of the magnet 78 is exposed adjacent an upper portion 86 of magnet holder 74. Magnet 78 may be placed within pocket 80 through, for example, an open cutout 88 in a bottom portion 90 of magnet holder 74. Magnet 78 may be press-fit, glued or otherwise secured within pocket 80. As with the embodiment depicted in FIG. 5, magnets 78 are preferably oriented such that all magnets 78 have their polarity N-S oriented in the same direction. With this configuration, cover 210 can be folded into a storage position as depicted in FIG. 6.

In a preferred embodiment shown, each magnet holder 74 and 75 also includes a plurality of barbs 92 formed on at least one of the opposing end portions 93 and 94 thereof. Assembly of cover 210 will now be discussed with reference to FIG. 8. During assembly, magnet holders 74 and 75 are inserted through openings 96 into each respective pocket 70 and 71. Barbs 92 extend at an angle from magnets holders 74 and 75 such that, once inserted into pockets 70 and 71, the angled barbs 92 engage or catch the material of the pockets 70 and 71 and aid in retaining magnet holders 74 and 75 within the respective pockets 70 and 71. Although a set of four barbs is shown for each magnet holder 74 and 75, it should be understood that any desirable number of barbs can be utilized. Additionally, it should be understood that barbs 92 can be made with jagged edges or textured surfaces to aid in retention of the magnet holders 74 and 75 within cover 210. With this configuration, openings 96 need not be sewn shut in order to retain magnet holders 74 and 75 within cover 210, thus saving a manufacturing step and simplifying construction of cover 210. Magnets holders 74 and 75 can be understood to evenly distribute magnetic pressure from magnets 78 along the length of cover 201, thereby helping to create a seal against the vehicle 12 when in use. Magnet holders 74 and 75 also provide stiffness to opposing side portions of cover 210, thereby aiding in the one-handed application of cover 210 to a vehicle surface 12.

Although described with reference to preferred embodiments of the invention, it should be readily understood that various changes and/or modifications can be made to the invention without departing from the spirit thereof. For instance, means for attaching magnets to the cover 10 other than those discussed above may be utilized. For example, main body 18 may be made from two sheets fused together to form pockets for magnets and/or magnet holders. Various aspects of the invention can be combined to form different embodiments. For example, detachable handle 120 may be utilized with any embodiment of the main body portion discussed herein. In general, the invention is only intended to be limited by the scope of the following claims.

We claim:

1. A magnetic cover for vehicle door handles comprising:

a flexible waterproof sheet sized to fit over a vehicle door handle, the sheet having a length including opposing outer surfaces;

a flexible waterproof handle attached to the sheet, the flexible waterproof handle having a length that is longer than the length of the sheet;

a plurality of magnets connected to an outer peripheral portion of the flexible waterproof sheet, wherein in use, the plurality of magnets magnetically adhere to a metal vehicle body in order to attach the vehicle door handle cover to the vehicle body in a removable manner wherein the handle includes stiffener ribs along a length of the handle, which aid in holding the handle away from the sheet during use such that the handle is easily grabbed by a user.

2. The magnetic cover of claim 1, wherein each magnet is positioned with the polarity of the magnet in the same direction.

3. The magnetic cover of claim 1, further comprising:

first and second magnet holders, each of the first and second magnet holders having a length, wherein the plurality of magnets are attached to the length of each of the first and second magnet holders in a spaced relationship.

4. The magnetic cover of claim 3, wherein the plurality of magnets on the first magnet holder align with the plurality of magnets on the second magnet holder such that the first and second magnet holders attract one another, allowing the vehicle door handle cover to be folded in a storage position wherein the first magnet holder is magnetically attached to the second magnet holder.

5. The magnetic cover of claim 3, further comprising:

first and second pockets formed on opposing side portions along the length of the sheet, wherein each of the first and second magnet holders includes barbs that engage the inside of the first and second pockets to aid in retaining the first and second magnet holders within respective first and second pockets.

6. The magnetic cover of claim 1, wherein the handle is removably attached to the sheet.

7. The magnetic cover of claim 1, wherein the plurality of magnets are each retained within a pocket formed in the sheet.

8. The magnetic cover of claim 3, wherein each of the first and second magnet holders includes magnet receiving pockets formed therein, wherein the magnets are housed within the magnet receiving pockets.

9. The magnetic cover of claim 3, wherein each of the first and second magnet holders has a stiffness which is greater than the stiffness of the sheet.

10. A method for assembling a magnetic cover for vehicle door handles comprising:

attaching a flexible waterproof handle to a flexible waterproof sheet sized to fit over a vehicle door handle, the sheet having a length including opposing outer surfaces, wherein the handle has a length that is longer than the length of the sheet;

inserting a first magnet holder into a first pocket formed on a first side portion of the sheet; and inserting a second magnet holder into a second pocket formed on a second side portion of the sheet opposite said first side portion of the sheet.

11. The method of claim 10, further comprising:

engaging a plurality of barbs formed on each of the first and second magnet holders with the respective first and second pockets.

12. The method of claim 10, wherein attaching the flexible waterproof handle includes the steps of:

inserting a first end portion of the handle through a slot into a first handle retaining pocket formed in the sheet; and inserting a second end portion of the handle through a slot into a second handle retaining pocket formed in the sheet, wherein the handle is retained in an outwardly bowed position with respect to the sheet.

13. A magnetic cover for vehicle door handles comprising:

a flexible waterproof sheet sized to fit over a vehicle door handle, the sheet having a length including opposing outer surfaces;

a flexible waterproof handle attached to the sheet;

first and second magnet holders, each of the first and second magnet holders having a length, wherein a plurality of magnets are attached to the length of each of the first and second magnet holders in a spaced relationship such that, in use, the plurality of magnets magnetically adhere to a metal vehicle body in order to attach the vehicle door handle cover to the vehicle body in a removable manner.

14. The magnetic cover of claim 13, wherein the handle includes stiffener ribs along a length of the handle, which aid in holding the handle away from the sheet during use such that the handle is easily grabbed by a user.

15. The magnetic cover of claim 13, wherein each magnet is positioned with the polarity of the magnet in the same direction.

16. The magnetic cover of claim 13, wherein the plurality of magnets on the first magnet holder align with the plurality of magnets on the second magnet holder such that the first and second magnet holders attract one another, allowing the vehicle door handle cover to be folded in a storage position wherein the first magnet holder is magnetically attached to the second magnet holder.

17. The magnetic cover of claim 13, further comprising:

first and second pockets formed on opposing side portions along the length of the sheet, wherein each of the first and second magnet holders includes barbs that engage the inside of the first and second pockets to aid in retaining the first and second magnet holders within respective first and second pockets.

18. The magnetic cover of claim 13, wherein the handle is removably attached to the sheet.

19. The magnetic cover of claim 13, wherein each of the first and second magnet holders includes magnet receiving pockets formed therein, wherein the magnets are housed within the magnet receiving pockets.

* * * * *